United States Patent [19]

Uesaka et al.

[11] 4,295,110

[45] Oct. 13, 1981

[54] ADJUSTING DEVICE FOR COLOR CATHODE RAY TUBE

[75] Inventors: Tatsuo Uesaka; Hiroshi Sugahara, both of Amagasaki; Takeo Fujimura, Nagaokakyo, all of Japan

[73] Assignee: Mitsubishi Denki Kabushiki Kaisha, Tokyo, Japan

[21] Appl. No.: 47,993

[22] Filed: Jun. 13, 1979

[30] Foreign Application Priority Data

Jun. 24, 1978 [JP] Japan ..... 53/76644

[51] Int. Cl.[3] ..... H01F 1/00

[52] U.S. Cl. ..... 335/212; 335/284

[58] Field of Search ..... 335/210, 212, 213, 284, 335/303

[56] References Cited

U.S. PATENT DOCUMENTS

| | | | |
|---|---|---|---|
| 3,098,942 | 7/1963 | Reiches | 335/210 X |
| 4,105,983 | 8/1978 | Barten et al. | 335/210 X |
| 4,138,628 | 2/1979 | Smith | 335/210 X |
| 4,152,684 | 5/1979 | Heijnemans et al. | 335/210 |
| 4,159,456 | 6/1979 | Smith | 335/210 |
| 4,162,470 | 7/1979 | Smith | 335/284 |

OTHER PUBLICATIONS

"30AX: Self-Aligning Self-Converging High-Definition 110° Colour TV Display," Philips Company Technical Note 076.

*Primary Examiner*—George Harris

*Attorney, Agent, or Firm*—Wenderoth, Lind & Ponack

[57] ABSTRACT

A barium ferrite layer is disposed around an external surface of neck portion of a color cathode ray tube to have a magnetic easy axis radially of the longitudinal axis of the neck portion. An electromagnet is revolved around the layer to magnetically charge it so as to correct static convergence and color purity of three electron beams generated in the color cathode ray tube.

3 Claims, 6 Drawing Figures

PRIOR ART

ADJUSTING DEVICE FOR COLOR CATHODE RAY TUBE

BACKGROUND OF THE INVENTION

This invention relates to an adjusting device for a color cathode ray tube, and more particularly to such a device for adjusting the static convergence and color purity of electron beams in a color cathode ray tube.

As well known, the front panel of color cathode ray tubes has a multiplicity of phosphor dots for each of three primary color located on the internal surface thereof at positions where electrons of an electron beam from an associated electron gun land successively after having passed through a shadow mask disposed adjacent to the internal surface of the front panel. However, those electrons may not actually land at their assigned phosphor dots for various reasons and principally due to deviations of mounting positions and directions of the electron guns and those of relative positions and directions therebetween. More specifically, upon manufacturing color cathode ray tubes, one first presumes positions and directions of the triad of electron guns for the respective primary colors disposed within the neck portions thereof and then applies phosphor dots or stripes for each of the primary colors to the internal surface of the front panel thereof on the basis of the presumed position and direction of an associated one of the electron guns. Thus, a phosphor screen is formed on the internal surface of the front panel. Subsequently, the three electron guns are put at their presumed position and in the presumed direction as accurately as possible within the neck portion. At that time, if the electron guns have the actual positions and directions more or less deviating from the presumed positions and directions thereof respectively, then electron beams from the electron guns pass through a few stages of electron lenses to be classified in positional and directional differences until each electron beam lands on a phosphor screen or stripes at positions far removed from their correct positions. This results in errors of the static convergence and color purity of the electron beams which may be called hereinafter a "color deviation or mislanding." Since glass forms the great part of the structural members located about the three electron guns, deviations inevitably occur between the presumed positions and directions and the actual positions and directions of the electron guns. Therefore the color deviation necessarily occurs.

In order to adjust static convergence and color purity errors of electron beams in color cathode ray tubes, it is required to exert magnetic fields having independent directions and strengths on the electron beams respectively and there has been already known an adjusting device formed of three pairs of annular permanent magnets disposed at predetermined equal intervals around the neck portion of color cathode ray tubes. Each pair of permanent magnets are operative to establish a dipole, a quadrupole or a sextupole magnetic field. Each pair of associated permanent magnets have been simultaneously rotated about the longitudinal axis of the neck portion to change the direction of the mating magnetic field and also a relative angle between those two permanent magnets has been changed to vary the strength of that magnetic field to thereby adjust electron beam paths and therefore the static convergence and color purity of electron beams. Then, the three pair of annular permanent magnets have been fixed in their changed positions.

Conventional adjusting devices such as above described have been disadvantageous in that (1) the adjustment consumes long time because the six annular permanent magnets are separately rotated to adjust electron beam paths and then fixed in their rotated positions, (2) because of the presence of the six permanent magnets, the adjusting devices are so large as to hamper the assembling of the deflecting device which is to be mounted to the color cathode ray tubes, and (3) the adjustment is required to be manually effected, resulting in the impossibility of effecting an automatic adjustment.

It is a general object of the present invention to eliminate the disadvantages of the prior art practice as described above.

It is an object of the present invention to provide a new and improved adjusting device for a color cathode ray tube capable of effecting the highly precise adjustment with a small-sized magnet and contributing to improvements in stabilization of the performance of the color cathode ray tube.

It is another object of the present invention to provide a new and improved adjusting device for a color cathode ray tube, permitting a deflection device to be easily disposed on and removed from the color cathode ray tube.

It is still another object to the present invention to provide a new and improved adjusting device for a color cathode ray tube readily changed into a magnetization pattern as required and permitting the adjusting operation to be automatically performed.

SUMMARY OF THE INVENTION

The present invention provides an adjusting device for a color cathode ray tube comprising a neck portion of a color cathode ray tube, electron gun means disposed within the neck portion, and magnetic member fixedly secured to the external surface of the neck portion and magnetized into a predetermined magnetization pattern.

The predetermined magnetization pattern is effective for correcting the static convergence and color purity of electron beams from the electron gun means.

The magnetic member may be preferably magnetized into the predetermined magnetization pattern after the same is fixedly secured to the external surface of the neck portion of the color cathode ray tube.

The magnetic member may be advantageoulsy formed by applying a mixture of a powdered magnet material such as barium ferrite and a binder to the external surface of the neck portion of the color cathode ray tube to form a layer and by subsequently heating the layer.

The magnetic member is formed of a magnetically anisotropic rubber magnet material having a magnetic easy axis perpendicular to the external surface of the neck portion.

The magnetic member may have a conveniently magnetized direction which is effected by revolving therearound a magnetically charging position where an electromagnet magnetically charges the magnetic member, and the strength of its charged magnetic field is effected by reversely magnetizing the central portion of a charged magnetic pole.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
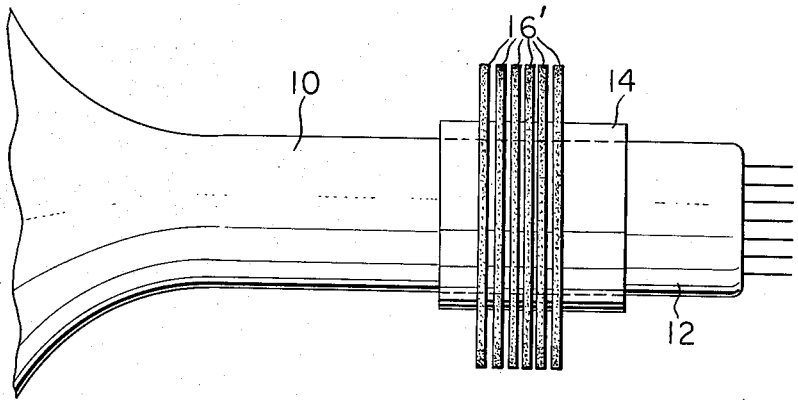
FIG. 1 PRIOR ART
FIG. 1 is a fragmental plan view of a color cathode ray tube illustrating a conventional adjusting device therefor.

Referring now to FIG. 1 of the drawings, there is illustrated a conventional adjusting device for color cathode ray tube. The arrangement illustrated comprises a color cathode ray tube 10 including a neck portion 12 having three electron guns (not shown) disposed therein, a supporting member 14 in the form of a band fixedly secured to the external surface of the neck portion 12 to wrap tightly the latter, and an annular magnet assembly 16' rotatably disposed on the supporting member 14 to be coaxial with the neck portion 12.

The magnetic assembly 16' forms a neck magnet with the supporting member 14 and is usually formed of three pairs of annular permanent magnets disposed at predetermined equal intervals around the supporting member 14. The magnet assembly 16' includes a first pair of dipole charged annular magnets, a second pair of quadrupole charged annular magnets and a third pair of sextupole charged annular magnets. Each pair of annular magnets are simultaneously revolved about the longitudinal axis of the neck portion 14 of the color cathode ray tube 10 to change a direction of an associated magnetic field established in the neck portion 12 and a relative angle between that pair of annular magnets is changed to vary the strength of that magnetic field to thereby adjust the static convergence and color purity of the three electron beams from the electron guns (not shown). Then, the three pairs of annular magnets 16 are fixed in their changed positions.

The magnet assembly 16 establishes, within the neck portion 12 of the color cathode ray tube 10, magnetic fields functioning to exert forces on electron beams traveling therethrough so as to correct their actual positions and directions to concide with their initially presumed positions and directions resulting from the presumed positions and directions of the electron guns to improve the static convergence and color purity, that is, the color deviation of the electron beams through the selective revolution of the three pair of annular magnets as described above. At that time, the electron guns are maintained at their positions where they have been fixed once.

As the magnet assembly 16' is required to correct positional and directional deviations of the three electron guns, the same is apt to be of a fairly complicated construction. As above described, the magnet assembly 16' has been generally formed of six annular permanent magnets including two dipole charged magnets, two quadrupole charged magnets and two sextupole magnets. In other words, conventional neck magnets have been composed of the six annular preliminarly charged magnets 16' and the supporting member 14 therefor serving as a fixing jig and have had the following disadvantages. (1) The adjustment consumes a long period of time because the six annular magnets are rotated to adjust electron beam paths and then fixed in their rotated positions. (2) The six annular magnets are assembled into a large-sized structure which obstructs the assembly and mounting of the deflecting device to the color cathode ray tube. (3) Because of the shape, the adjustment is required to be manually effected resulting in the impossibility of effecting an automatic adjustment.

Figure 2:
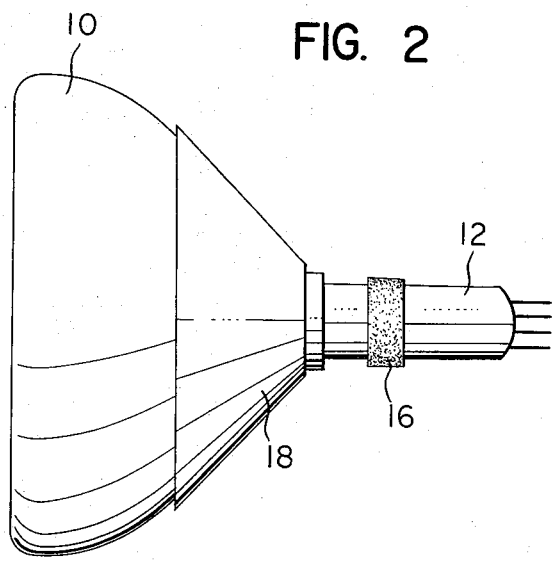
FIG. 2 is a fragmental plan view of a color cathode ray tube including the adjusting device of the present invention therefor.

Referring now to FIG. 2 wherein like reference numerals designate the components identical or corresponding to those shown in FIG. 1, there is illustrated one embodiment according to the adjusting device of the present invention for color cathode ray tubes. The arrangement illustrated is different from that shown in FIG. 1 only in that in FIG. 2, a sheet magnet 16 encircles, in an intimate contact relationship, the external surface of the neck portion 12 of the color cathode ray tube 10 as a substitute for the magnet assembly 16' and the supporting member 14. In FIG. 2, an assembly comprising a deflecting device 18 is also shown as partly surrounding the funnel shaped portion of the color cathode ray tube 10. In the embodiment illustrated, the sheet magnet 16 forming the adjusting device is produced by coating a mixture of a powered magnet material of barium ferrite and a plastic binder in a predetermined area of the external surface of the neck tube portion 12 to form a coating encircling the neck portion 12 and affixing it to the predetermined area by heat.

Figure 3:
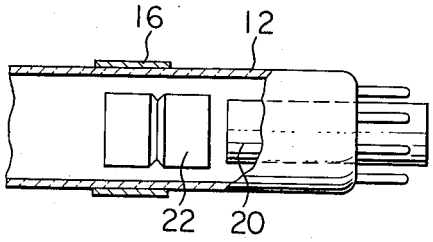
FIG. 3 is a plan view partly in a longitudinal section of the neck portion of the color cathode ray tube shown in FIG. 2.

FIG. 3 is a fragmental plan view, partly in longitudinal section of the neck portion 12 shown in FIG. 2. As shown in FIG. 3, three electron guns represented by a rectangle 20 are disposed within the neck portion 12 adjacent to the bottom thereof and an electron lens 22 is located in the front of the electron guns in the manner well known in the art. The magnet 16, which has been produced as described above, is positioned to surround that portion of the electron lens 22 remote from the electron guns 20.

The adjustment of the color deviation according to the present invention will now be described in conjunction with FIG. 4 wherein there are illustrated in cross-section the sheet or tape-shaped magnet 16 disposed around the neck portion 12 to intimately contact the latter and in plan a U-shaped electromagnet 24 for magnetically charging the magnet 16. The U-shaped electromagnet 24 includes a pair of opposite magnetic pole pieces 26 formed of tapered end portions of the U's legs extending toward each other to form a small air gap therebetween and a magnetizing winding 28 inductively disposed on both legs.

Figure 4:
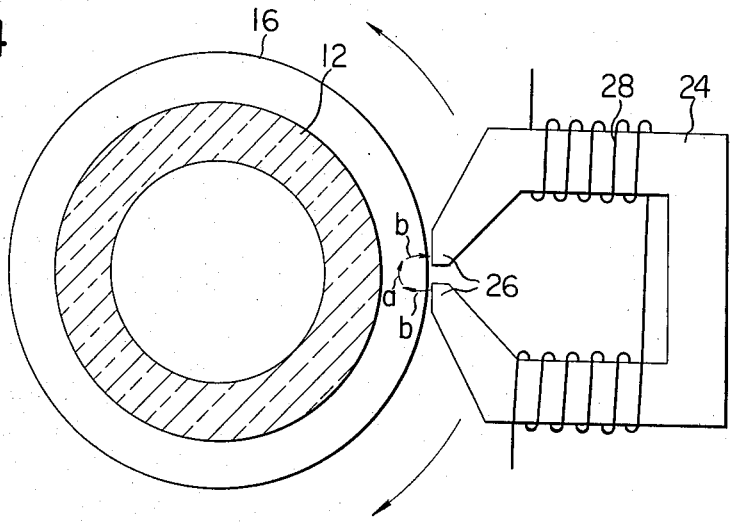
FIG. 4 is a cross-sectional view of the neck portion shown in FIGS. 2 and 3 with parts omitted and with a magnetically charging electromagnet illustrated in plan.

While a magnetizing current flows through the magnetizing winding 28, the magnetic pole pieces 26 of the electromagnet 24 approaches the taped magnet 16 as shown in FIG. 4. Under these circumstances, the electromagnet 24 revolves about the magnet 16 to magnetically charge the latter into such a magnetization pattern that the color deviation or the static convergence and color purity is properly adjusted.

It has been found that, when the magnetization pattern is varied with an associated color cathode ray tube placed in operation, the resulting color deviation is varied correspondingly. Then, the magnet 16 has been magnetically charged so that the entire phosphor screen of the color cathode ray tube exhibits the least color deviation, that is to say, so that the mounting tolerance of three electron guns has been corrected. Thereafter, the electromagnet 24, having a low alternating current flowing through the winding 28 thereof, has been revolved around the taped-shaped magnet 16 to more or less demagnetize the latter to thereby stabilize the magnetization thereof. The magnetized charging electromagnet 24 has been moved around the tape-shaped magnet 16 in such a manner that it is moved peripherally of the magnet 16 and also axially of the neck portion 12 while a small interval is put between the tape-shaped magnet 16 and the electromagnet 24. The resulting magnetically charged pattern has basically resembled the magnetization pattern exhibited by conventional assemblies of dipole, quadrupole and sextupole charge annular magnets such as the magnet assembly 16' shown in FIG. 1 that is, the patterns are similar in positions and strengths of magnetic poles and directions of magnetic fields. It has been found that, by controlling the revolving movements of the charging electromagnet 24, and by controlling the axial movement thereof along the longitudinal axis of the neck tube portion 12, and by controlling the amplitude and direction of a current pulse flowing through the magnetizing electromagnet winding 28, the resulting magnetically charged pattern is enabled so as to effectively correct the color deviation, even though the charged pattern is relatively simple.

As an example, barium ferrite was used to prepare a magnetically anistropic rubber magnet sheet having a thickness of 0.75 millimeter, a width of 10 millimeters and a magnetic easy axis perpendicular to the surface thereof, or radially of the longitudinal axis of the neck portion 12. The magnet sheet thus prepared was wound in an intimate contact relationship around the external surface of the neck portion 12 at a predetermined position and attached thereto to form the tape-shaped magnet 16. Then, the magnet 16 was magnetically charged with the electromagnet 28 in the manner as described above in conjunction with FIG. 4.

As shown in FIG. 4, a magnetic field generated by the electromagnet 24 had a pair of field components a and b parallel and perpendicular to the external surface of the magnet 16 respectively. Since the magnet 16 had the magnetic easy axis perpendicular to the surface thereof, the charged magnet 16 was magnetized in a direction perpendicular to the surface thereof. This magnetization has its sense as determined by a direction in which the electromagnet 24 is revolved around the magnet 16, even though the current flowing through the magnetizing winding 28 of the electromagnet 24 remains unchanged.

Figure 5:
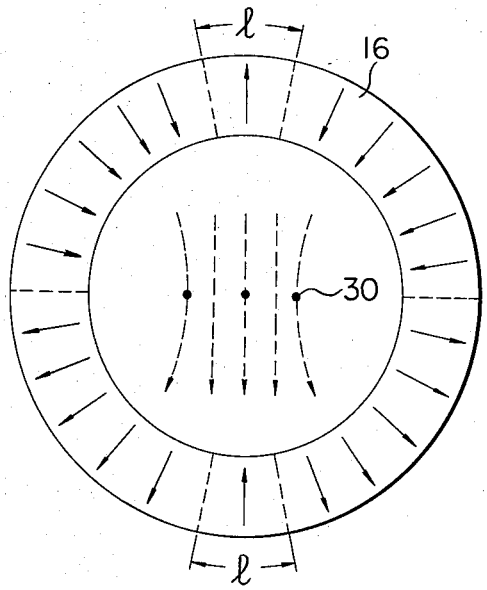
FIG. 5 is a diagram of a magnetization pattern into which an embodiment according to the adjusting device of the present invention is magnetically charged.

FIG. 5 shows a magnetically charged pattern of a dipole magnetic field portion established in the tape-shaped magnet 16 after it has been magnetically charged as described above. In FIG. 5, the solid arrow indicates the magnetization sense and the thickness of the magnet 16 is exaggerated in order to facilitate a understanding of the magnetically charged pattern.

The role of the dipole magnetic field (see the dotted arrow in FIG. 5) is to move three electron beams 30 (see FIG. 5) in the same direction so as to adjust the color purity thereof. Therefore, it is necessary to adjust the strength and sense of the dipole magnetic field. The adjustment of the sense of the magnetic field is accomplished by revolving around the magnet 16 the position where the electromagnet 24 magnetically charges the magnet 16. However, the strength of the magnetic field is not adjusted by controlling the magnitude of the magnetization. The magnetic strength is adjusted by reversely magnetizing the central portion having an arc length l (see FIG. 5) of each magnetic pole of the dipole magnetic field. A decrease in arc length l results in an increase in strength of the magnetic field developed at a position through which each of the electron beams passes along the longitudinal axis of the neck portion and vice versa. At that time, it is to be noted that this reverse magnetization does not change the direction of the magnetic field.

From the foregoing it will readily be understood that the magnetic charging for generating a dipole magnetic field results in the formation of a sextupole magnet.

If desired, the central portion having the arc length l of each magnetic pole may be demagnetized but not reversely magnetized.

Similarly a quadrupole or a sextupole magnetic field may be established by a magnetically charged pattern formed on the magnet 16 with a predetermined certain magnetization pattern and then reversing the direction of the magnetization for each of a plurality of suitable arc lengths of the magnet 16.

Figure 6:
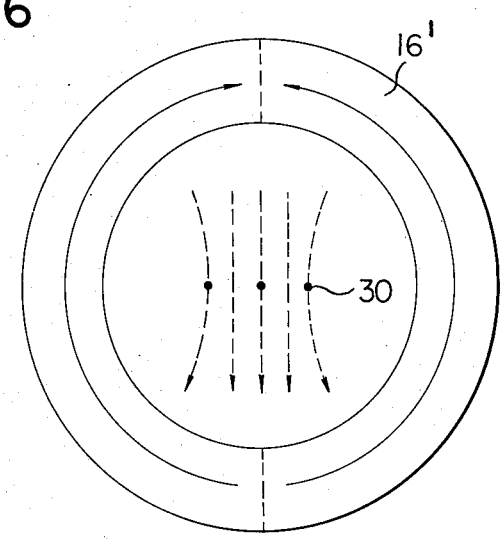
FIG. 6 is a diagram of a magnetization pattern into which a conventional adjusting device is magnetically charged.

For comparison purpose, a tape-shaped magnet such as the magnet 16 was formed of a magnetically isotropic rubber magnet sheet and magnetically charged by the electromagnet 24 as above described in conjunction with FIG. 4. At that time, the magnet is scarcely magnetized in a direction perpendicular to the surface thereof or a radial direction thereof because of the presence of a demagnetizing field. However, the magnet is magnetized in a plane perpendicular to the longitudinal axis thereof or in a circumferential direction thereof due to a component of the resulting magnetic field parallel to the surface of the magnet. If there is an attempt to establish a dipole magnetic field on the magnetically isotropic magnet, then the resulting magnetically charged pattern is substantially as shown in FIG. 6 wherein like reference numerals designate the components identical or corresponding to those shown in FIG. 5. From FIG. 6 it can be seen that the magnet 16 is circumferentially magnetized. Therefore, in order to adjust effectively the strength of the magnetic field developed at a position through which each electron beam passes, the magnetization must change in strength. Since materials for the permanent magnet have magnetization curves in the form of hysteresis loops, it is difficult to adjust the strength of the magnetization as described above. Also, if a magnetically charged pattern becomes fine, as in a sextupole magnetic field, then the charged permanent magnet increases in demagnetization effect, which makes it more difficult to adjust the strength of the magnetization.

From the foregoing it is seen that, after having fixed to the neck portion 12 of the color cathode ray tube 10, the tape-shaped magnet 16 (see FIGS. 2 and 3) can be magnetically charged at will be the electromagnet 24 with the magnetization controlled in strength. This permits a magnetic field having the number of magnetic poles far larger than could previously be obtained and can be established as desired on a tape-shaped magnet having a small area. In other words, the present invention gives the result that the color deviation can be highly corrected on the raster of color cathode ray tubes and that the neck magnet is small as compared with the prior art practice and stably fixed to the neck portion of color cathode ray tubes so as to increase the stability of the latter. Moreover, the adjustment of the color deviation can be accomplished with an inexpensive structure which can be easily mounted and removed from an associated cathode ray tube.

In addition, by using a magnetically anisotropic rubber magnet sheet having a magnetic easy axis perpendicular to the surface thereof, it is easy to adjust the strength of a magnetic field established on the magnet sheet and also to permit the automatic operation of adjusting the static convergence and color purity of electron beams in color cathode ray tubes.

While the invention has been illustrated and described in conjunction with a single preferred embodiment, it is to be understood that numerous changes and modifications may be resorted to without departing from the spirit and scope of the present invention. For example, the magnetically anisotropic rubber magnet may be of any of rare earth-cobalt alloys, cobalt alloys etc. The powdered magnet material may be mixed with any desired binder other than a plastic binder. Further a wire ring formed of any suitable magnet material may be fixedly fitted upon the neck portion of color cathode ray tube prior to the magnetization thereof.

What we claim is:

1. An adjusting device for a color cathode ray tube comprising:

a neck portion of a color cathode ray tube;

electron gun means disposed within said neck portion;

a magnetic member fixedly secured to an external surface of said neck portion and magnetized into a predetermined magnetization pattern;

wherein said predetermined magnetization pattern is effective for correcting the static convergence and color purity of electron beams emitted from said electron gun means;

wherein said magnetic member is magnetized after being fixedly secured to said external surface of said neck portion;

and wherein said magnetic member is formed of a magnetically anisotropic sheet-shaped magnet material having a magnetic easy axis perpendicular to said external surface of said neck portion.

2. An adjusting device for color cathode ray tube comprising:

a neck portion of a color cathode ray tube;

electron gun means disposed within said neck portion;

a magnetic member fixedly secured to an external surface of said neck portion and magnetized into a predetermined magnetization pattern;

wherein said predetermined magnetization pattern is effective for correcting the static convergence and color purity of electron beams emitted from said electron gun means;

wherein said magnetic member is magnetized after being fixedly secured to said external surface of said neck portion;

and wherein said magnetic member is formed of a magnetically anisotropic sheet-shaped magnet material having a magnetic easy axis perpendicular to said external surface of said neck portion;

and wherein said magnetic member has a magnetization direction determined by revolving a magnetically charged U-shaped electromagnet around said magnetic member; said electromagnet spaced from said magnetic member by an air gap and arranged to produce a magnetic flux which is substantially perpendicular to said external surface of said neck portion.

3. An adjusting device for a color cathode ray tube comprising:

a neck portion of a color cathode ray tube;

electron gun means disposed within said neck portion;

a magnetic member fixedly secured to an external surface of said neck portion and magnetized into a predetermined magnetization pattern;

wherein said predetermined magnetization pattern is effective for correcting the static convergence and color purity of electron beams emitted from said electron gun means;

wherein said magnetic member is magnetized after being fixedly secured to said external surface of said neck portion;

and wherein said magnetic member is formed by coating a mixture of a powdered magnetic material and a binder on said external surface of said neck portion and heating the resulting coated mixture.

* * * * *